US008479414B2

(12) United States Patent
Baker et al.

(10) Patent No.: US 8,479,414 B2
(45) Date of Patent: Jul. 9, 2013

(54) FOOTWEAR INSOLE

(75) Inventors: Brian D. Baker, Portland, OR (US); Daniel W. Peter, Portland, OR (US)

(73) Assignee: Nike, Inc., Beaverton, OR (US)

( * ) Notice: Subject to any disclaimer, the term of this patent is extended or adjusted under 35 U.S.C. 154(b) by 491 days.

(21) Appl. No.: 12/714,776

(22) Filed: Mar. 1, 2010

(65) Prior Publication Data

US 2011/0209360 A1 Sep. 1, 2011

(51) Int. Cl.
*A43B 13/38* (2006.01)
*A43B 13/40* (2006.01)

(52) U.S. Cl.
USPC ..... 36/44; 36/43

(58) Field of Classification Search
USPC ..... 36/3 R, 3 B, 30 R, 31, 43, 44
See application file for complete search history.

(56) References Cited

U.S. PATENT DOCUMENTS

| | | | | |
|---|---|---|---|---|
| 4,179,826 | A * | 12/1979 | Davidson | 36/69 |
| 4,215,492 | A * | 8/1980 | Sandmeier | 36/44 |
| 4,654,982 | A * | 4/1987 | Lee | 36/3 R |
| 5,068,983 | A * | 12/1991 | Marc | 36/44 |
| 5,172,494 | A * | 12/1992 | Davidson | 36/35 R |
| 6,477,792 | B2 * | 11/2002 | Sartor | 36/44 |
| 7,152,341 | B2 * | 12/2006 | Dean | 36/24.5 |
| 7,377,057 | B2 * | 5/2008 | Lacorazza et al. | 36/35 R |
| 7,716,852 | B2 | 5/2010 | Berger et al. | |
| 2001/0032400 | A1 | 10/2001 | Brooks | |
| 2009/0049712 | A1 | 2/2009 | Steszyn et al. | |
| 2009/0188131 | A1 | 7/2009 | Doerer et al. | |

FOREIGN PATENT DOCUMENTS

| | | |
|---|---|---|
| DE | 19830121 | 1/2000 |
| DE | 10036100 | 2/2002 |
| DE | 20122244 | 9/2004 |
| DE | 60105727 | 11/2005 |
| EP | 1197157 | 4/2002 |
| ES | 2227029 | 4/2005 |
| JP | 2002078506 | 3/2002 |
| JP | 2007330365 | 12/2007 |
| JP | 2008012203 | 1/2008 |

OTHER PUBLICATIONS

International Search Report and Written Opinion mailed Jul. 1, 2011 in International Application No. PCT/US2011/026433.
International Preliminary Report on Patentability (including Written Opinion of the ISA) mailed Sep. 13, 2012, in International Application No. PCT/US2011/026433.
Response filed Jan. 18, 2013 in European Patent Application No. EP 11 715 784.2.

* cited by examiner

*Primary Examiner* — Jila M Mohandesi
*Assistant Examiner* — Sharon M Prange
(74) *Attorney, Agent, or Firm* — Plumsea Law Group, LLC

(57) ABSTRACT

Embodiments provide an insole having a multilayered construction with openings and ribs sized, shaped, and positioned to provide desired areas of stiffness and flexibility. The multilayered construction may include a chassis defining a support member opening and a support member covering the opening and positioned between the chassis and a cushioning layer. The chassis may define a plurality of apertures in the forefoot portion, which, in a direction from the forefoot end to the heel end, progressively increase in size to a point at which maximum flexibility is desired in the forefoot portion. The bottom of the support member may include protruding ribs that extend generally in a longitudinal direction from the midfoot to the heel, and include a straight middle rib, a medial side rib convex with respect to the middle rib, and a lateral side rib convex with respect to the middle rib.

26 Claims, 10 Drawing Sheets

FOOTWEAR INSOLE

BACKGROUND

The present invention relates generally to footwear, and in particular, to a multilayered footwear insole having apertures and ribs sized, shaped, and positioned to provide desired areas of stiffness and flexibility.

To achieve desired comfort and support for the foot when using an article of footwear, designers often include an insole to conform to the shape and contours of the foot and provide structural support and cushioning. Prior art insoles have therefore included layers of foam material for cushioning and comfort, along with areas of more rigid material, for support.

In addition to more rigid materials, some prior art designs use structural features to increase stiffness of a shoe insole. For example, some designs use ridges, ribs, or grid systems to affect torsion resistance, rigidity, and stability.

For additional comfort, some prior art designs also include openings within an insert to promote air flow. The openings may include, for example, orifices and passageways passing through and within layers.

Although prior art insole designs may provide some measure of comfort and support for a foot, increasing the number or thickness of cushioning layers can compromise flexibility, resulting in an insole that is too stiff. Thus, there remains a need in the art for insoles that achieve a desired balance between cushioning and flexibility. In addition, there remains a need for insoles that effectively provide separate areas of cushioning and support to accommodate different portions of the foot.

SUMMARY

Embodiments provide an insole having a multilayered construction with openings and ribs sized, shaped, and positioned to provide desired areas of stiffness and flexibility. To achieve desired comfort and support for the foot, an exemplary insole may conform to the shape and contours of the foot, provide structural support and cushioning for the foot, and protect the inside bottom surface of the footwear.

An aspect provides an insole for an article of footwear. The insole may include a chassis, a cushioning layer, and a support member. The chassis may have an upper surface and a lower surface, a lateral side and a medial side, a heel end and a forefoot end, and a heel portion, a midfoot portion, and a forefoot portion. The chassis may define a support member opening extending from the heel portion to the midfoot portion. The chassis may further define a plurality of first apertures in the forefoot portion. The cushioning layer may be attached to the upper surface of the chassis and extend from the heel end to the forefoot end. The cushioning layer may define a plurality of second apertures each aligned with a first aperture of the plurality of first apertures to provide a plurality of insole apertures. The support member may extend from the heel portion of the chassis to the midfoot portion of the chassis and cover the support member opening of the chassis. In a direction from the forefoot end toward the heel end, the insole apertures may progressively increase in size to a point at which maximum flexibility is desired in the forefoot portion.

In another aspect, the point at which maximum flexibility is desired in the forefoot portion may correspond to a line from the medial side to the lateral side, wherein the line is positioned generally to correspond to the metatarsophalangeal joints of a foot.

In another aspect, from the point toward the heel portion, the insole apertures may decrease in size.

In another aspect, the plurality of insole apertures may comprise rows of apertures aligned in straight lines extending generally from the lateral side to the medial side, and columns of apertures running in a direction generally from the forefoot end to the heel end.

In another aspect, insole apertures in the same row may have the same size.

In another aspect, the columns of apertures may comprise a first column having apertures aligned in a straight line, a medial side column having apertures positioned along a curved line that curves outward toward the medial side, and a lateral side column having apertures positioned along a curved line that curves outward toward the lateral side.

In another aspect, the support member may have a plurality of ribs each protruding from a surface of the support member opposite to the cushioning layer and extending generally in a longitudinal direction from the midfoot portion toward the heel portion, wherein the plurality of ribs comprises a first rib aligned in a straight line parallel to the longitudinal direction, a medial side rib that is convex with respect to the first rib, and a lateral side rib that is convex with respect to the first rib.

In another aspect, each rib of the plurality of ribs may comprise a first end and a second end, and the each rib may increase in width and thickness from the first and second end to a widest and thickest middle portion.

In another aspect, the first rib, the medial side rib, and the lateral side rib may each have a first end disposed in the midfoot portion and a second end opposite to the first end, wherein the first ends may be generally aligned in a direction from the medial side to the lateral side, and wherein the second end of the first rib may extend farther toward the heel end than the second end of the medial side rib, and wherein the second end of the lateral side rib may extend farther toward the heel end than the second end of the first rib.

In another aspect, the medial side rib may comprise a first medial side rib and the lateral side rib may comprise a first lateral side rib, wherein the plurality of ribs may further comprise a second medial side rib and a second lateral side rib, wherein the second medial side rib may be disposed on a side of the first medial side rib opposite to the first rib, wherein the second lateral side rib may be disposed on a side of the first lateral side rib opposite to the first rib, wherein the second medial side rib may be convex with respect to the first rib, and wherein the second lateral side rib may be convex with respect to the first rib.

In another aspect, the second medial side rib may have a radius of curvature less than that of the first medial side rib, and the second lateral side rib may have a radius of curvature less than that of the first lateral side rib.

In another aspect, the first rib, the first medial side rib, the second medial side rib, the first lateral side rib, and the second lateral side rib may each have a first end disposed in the midfoot portion and a second end opposite to the first end, wherein the first ends may be generally aligned in a direction from the medial side to the lateral side, wherein the second end of the first medial side rib may extend farther toward the heel end than the second end of the second medial side rib, wherein the second end of the first rib may extend farther toward the heel end than the second end of the first medial side rib, wherein the second end of the first lateral side rib may extend farther toward the heel end than the second end of the first rib, and wherein the second end of the second lateral side rib may extend farther toward the heel end than the second end of the first lateral side rib.

In another aspect, the first rib, the first medial side rib, the second medial side rib, the first lateral side rib, and the second lateral side rib may each have a first end disposed in the midfoot portion and a second end opposite to the first end, wherein the first ends may be generally aligned in a direction from the medial side to the lateral side, wherein the second end of the first medial side rib may extend farther toward the heel end than the second end of the second medial side rib, wherein the second end of the first rib may extend farther toward the heel end than the second end of the first medial side rib and the second end of the first lateral side rib, wherein the second end of the first lateral side rib may extend farther toward the heel end than the second end of the second lateral side rib, wherein the second ends of the first medial side rib and the first lateral side rib may be generally aligned in the direction from the medial side to the lateral side, and wherein the second ends of the second medial side rib and the second lateral side rib may be generally aligned in the direction from the medial side to the lateral side.

In another aspect, the chassis may define recesses along its perimeter in the heel portion.

In another aspect, the cushioning layer may be multilayered and may comprise a lower cushioning layer attached to the chassis and an upper resilient layer attached to the lower cushioning layer.

In another aspect, the insole may further comprise an insole liner attached to the cushioning layer on a side of the cushioning layer opposite to the chassis.

In another aspect, the support member may comprise a first material, the chassis may comprise a second material, and the cushioning layer may comprise a third material, and wherein the first material may be more rigid than the second material, and wherein the second material may be more rigid than the third material.

In another aspect, the support member may have a first end at the midfoot portion and a second end at the heel portion, wherein the support member may define an arch protrusion at the first end on the medial side, and wherein the support member may define a cupped shape at the second end.

In another aspect, the insole may further comprise the article of footwear.

In another aspect, the support member is sized and shaped larger than the support member opening of the chassis such that perimeter portions of the support member are disposed between the support member and the chassis.

Another aspect provides an insole for an article of footwear, the insole comprising a chassis layer. The chassis layer may have an upper surface and a lower surface, a lateral side and a medial side, a heel end and a forefoot end, and a heel portion, a midfoot portion, and a forefoot portion. The chassis layer may define a plurality of apertures in the forefoot portion. In a direction from the forefoot end to the heel end, the apertures may progressively increase in size to a point at which maximum flexibility is desired in the forefoot portion.

In another aspect, the point at which maximum flexibility is desired in the forefoot portion may correspond to a line from the medial side to the lateral side, wherein the line may be positioned generally to correspond to the metatarsophalangeal joints of a foot.

In another aspect, the plurality of apertures may be arranged in a plurality of rows, wherein each row may extend in a direction generally from the medial side to the lateral side, and wherein, in each row, the apertures may have the same size.

In another aspect, the plurality of apertures may be arranged in a plurality of rows and each row may extend in a direction generally from the medial side to the lateral side. The plurality of apertures may be arranged in columns of apertures running in a direction generally from the forefoot end to the heel end. The columns of apertures may comprise a first column having apertures aligned in a straight line, a medial side column having apertures positioned along a curved line that curves outward toward the medial side, and a lateral side column having apertures positioned along a curved line that curves outward toward the lateral side.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, embodiments provide a footwear insole intended to protect, cushion, and support a wearer's foot, and to protect the inside of an article of footwear. An embodiment provides an insole that includes a lower chassis, an intermediate support member, and an upper cushioning layer. The insole may have apertures configured to provide targeted flexibility in the forefoot portion of the insole, for example, by progressively increasing the size of the apertures in a direction from the forefoot end toward a point at which maximum flexibility is desired. The support member of the insole may have ribs configured to provide midfoot stiffness and controlled lateral and longitudinal bending of the insole.

Figure 1:
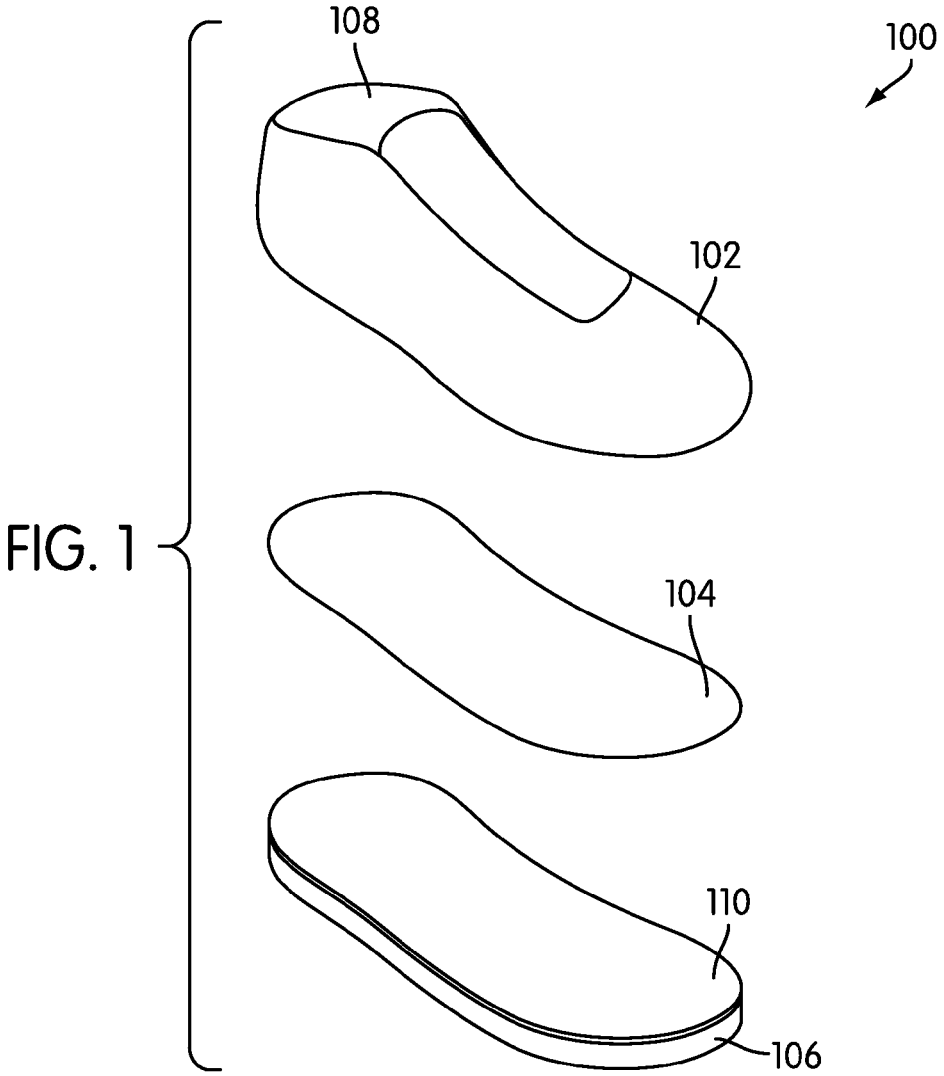
FIG. 1 is a schematic diagram illustrating an exploded isometric view of an embodiment of an article of footwear.

FIG. 1 is an exploded isometric view of an embodiment of article of footwear 100. Article of footwear 100 may include upper 102, insole 104, and outer member 106. Upper 102 and outer member 106 may be assembled together to form the outer structure of article of footwear 100. Insole 104 may be added or removed from article of footwear 100, by insertion or removal through opening 108. Opening 108 of upper 102 is also preferably configured to receive a wearer's foot. Outer member 106 may be configured to contact the ground during use of article of footwear 100.

Generally, outer member 106 may include any member configured to contact insole 104. In some embodiments, outer member 106 may include a midsole and an outsole. In other embodiments, outer member 106 may include just an outsole. In some embodiments, outer member 106 may optionally include intermediate layer 110. Intermediate layer 110 may be any layer disposed between outer member 106 and insole 104. In some embodiments, intermediate layer 110 may be a strobel sock.

Figure 2:
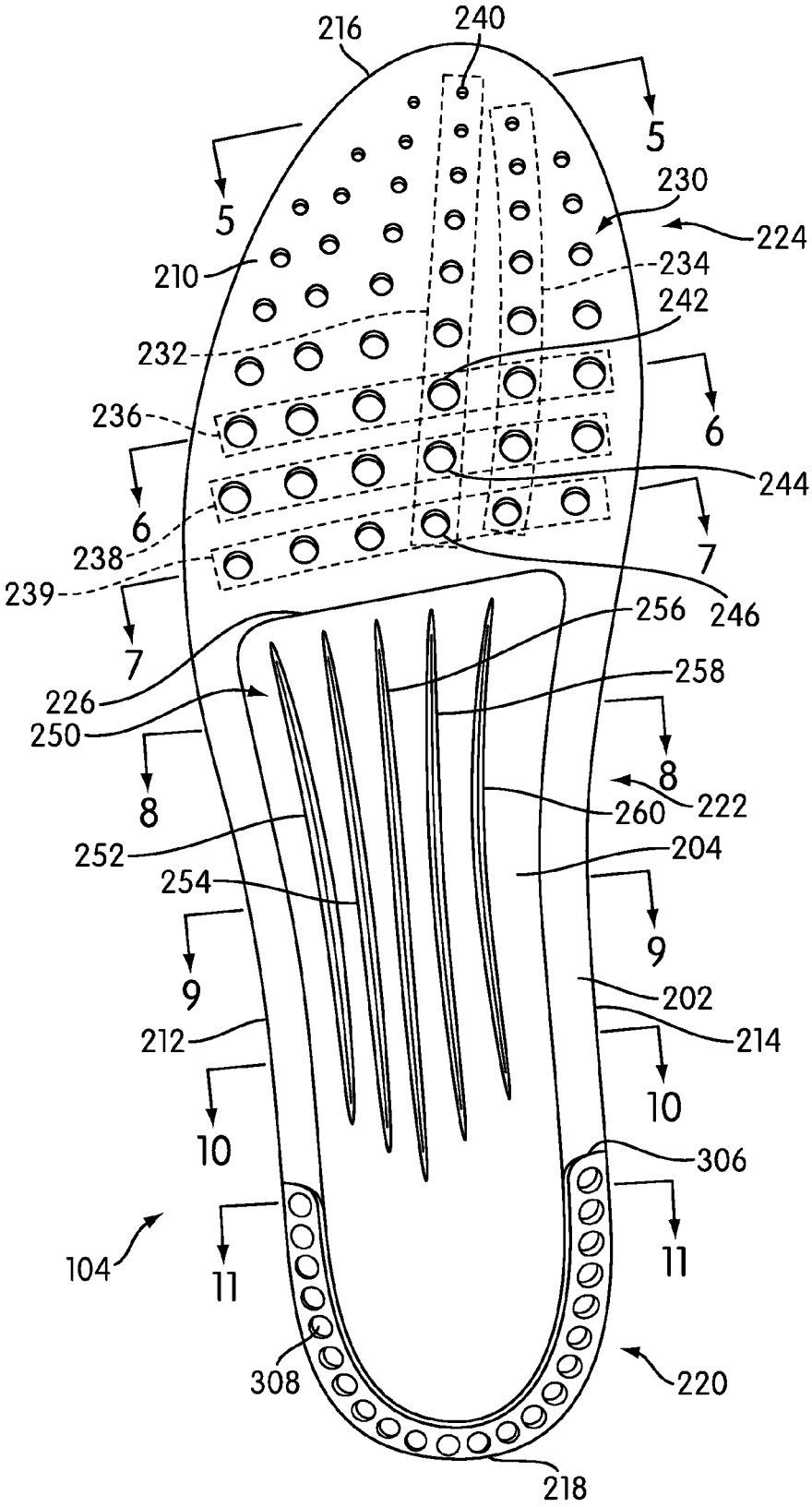
FIG. 2 is schematic diagram illustrating a plan view of the bottom of an embodiment of an insole.
Figure 3:
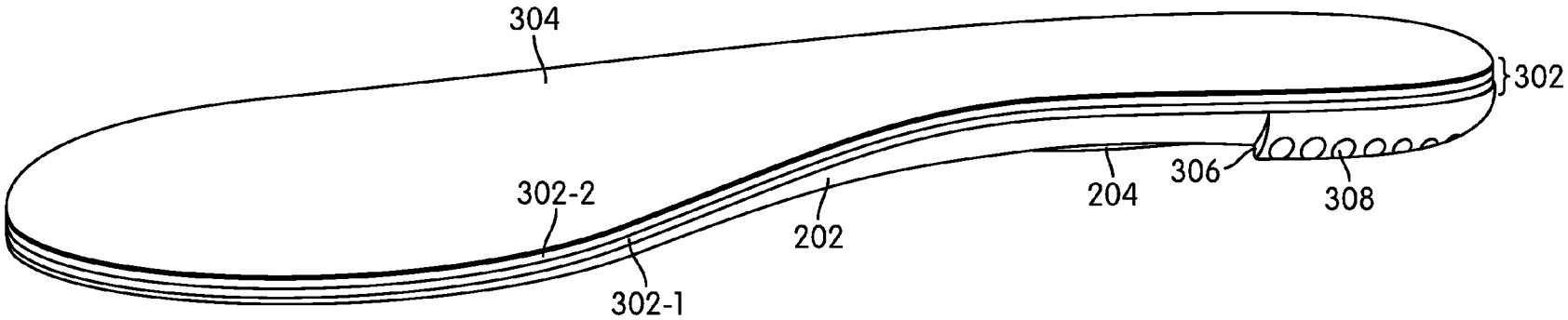
FIG. 3 is a schematic diagram illustrating a side isometric view of the exemplary insole of FIG. 2.
Figure 4:
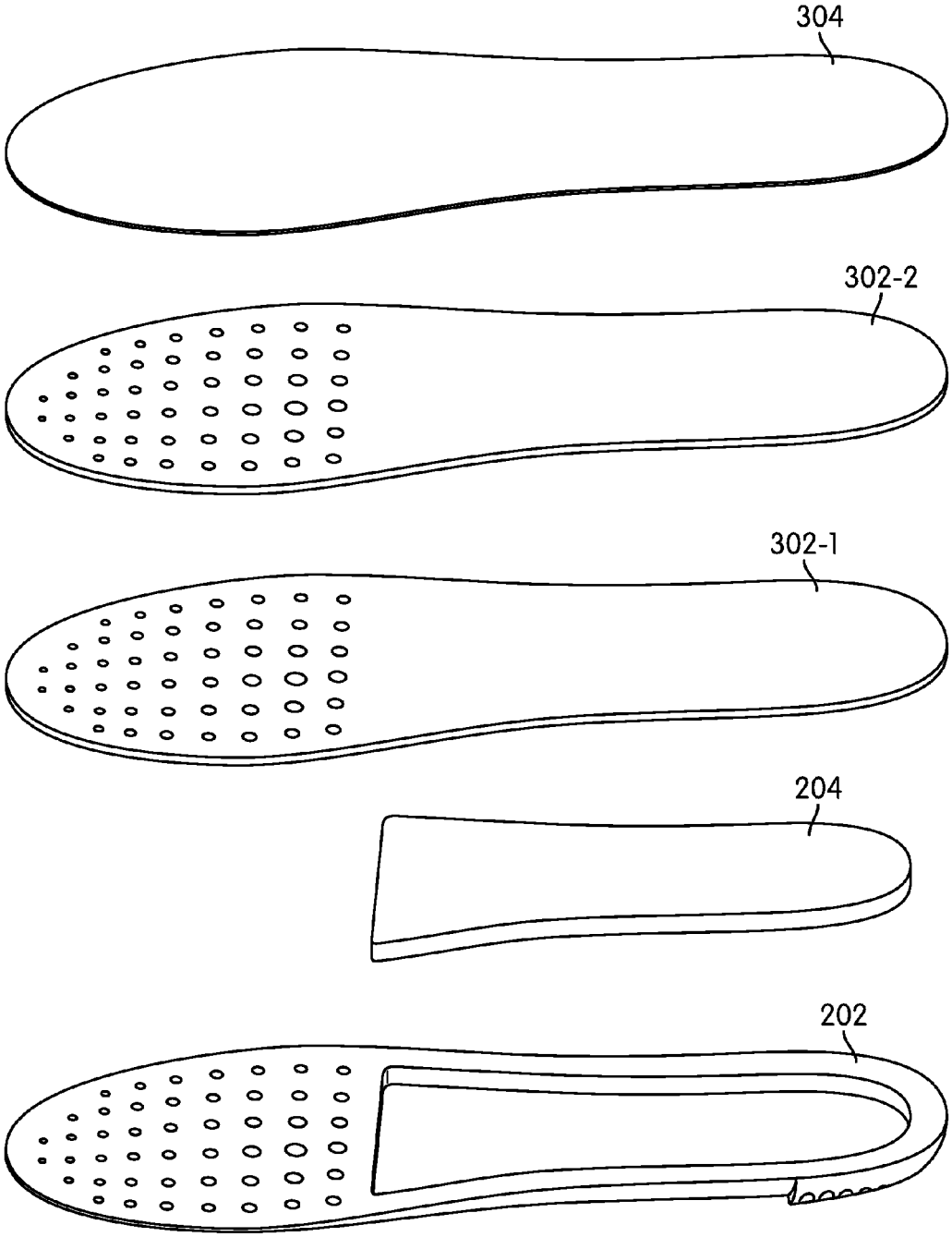
FIG. 4 a schematic diagram illustrating an exploded isometric view of the insole of FIG. 2.

FIGS. 2-4 illustrate an exemplary embodiment of insole 104, in a bottom plan view, side isometric view, and exploded isometric view, respectively. As shown, insole 104 may include a chassis 202, a support member 204, and a cushioning layer 302. Insole 104, as well as the layers that make up insole 104 (e.g., including the chassis 202), may include a lateral side 212 and a medial side 214, a forefoot end 216 and a heel end 218, and a heel portion 220, a midfoot portion 222, and a forefoot portion 224. Chassis 202 may have a lower surface 210 and an upper surface (not visible in FIGS. 2 and 3), and may define a support member opening 226.

Support member 204 may be positioned to cover the support member opening 226. For example, as shown in the cross-sectional view of FIGS. 8-11, support member 204 may be sized slightly larger than the support member opening 226 and may be sandwiched between the chassis 202 and the cushioning layer 302, to hold the support member 204 in place. Support member 204 may also be attached to the cushioning layer 302 and the chassis 202 by, for example, an adhesive or stitching. As another example, in covering opening 226, support member 204 may have a size and shape substantially matching that of the opening 226 and may be disposed within the opening 226, with the outer edges of the support member 204 attached to the inner edges of the support member opening 226, for example, by an adhesive, stitching, or injection molding.

Cushioning layer 302 may be attached to the upper surface of chassis 202, for example, by an adhesive, stitching, or injection molding. Cushioning layer 302 may also be attached to the upper surface of support member 204, for example, by an adhesive or stitching. Cushioning layer 302 may be a single layer of cushioning material, such as an EVA resin foam or a soft polyethylene foam. In one implementation, cushioning layer 302 may be a polyethylene foam having a specific gravity of about 0.05. Optionally, cushioning layer 302 may include multiple layers, for example, including a lower cushioning layer 302-1 and an upper more resilient layer 302-2, as shown in the exemplary embodiment of FIGS. 3 and 4. In such an embodiment, the upper more resilient layer 302-2 may provide a sense of instant comfort to a wearer, while the lower cushioning layer 302-1 may tend to compress and conform more to a wearer's foot, and also provide protection and comfort against hard surfaces of an outsole and/or the ground. In one embodiment using insole 104 in a soccer shoe, lower cushioning layer 302-1 may distribute the force of studs pressing upward from the bottom of the outsole, while the upper resilient layer 302-2 may provide an immediate sense of comfort. The different layers of cushioning layer 302 may be made of different types of EVA resin foam.

Chassis 202 may comprise a material that is more rigid than that of the cushioning layer 302. For example, chassis 202 may comprise a type of polyethylene foam that is more rigid than a soft polyethylene foam used in some embodiments to form cushioning layer 302. Support member 204 may be more rigid than both chassis 202 and also cushioning layer 302. Support member 204 may be formed of an impact resistant material, such as thermoplastic urethane.

Figure 5:
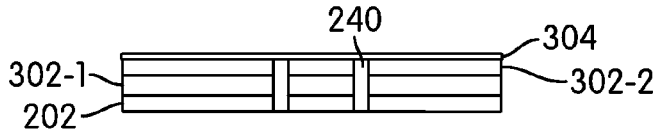
FIG. 5 is a schematic diagram of a cross-sectional view of the exemplary insole of FIG. 2 taken along line 5-5 in FIG. 2, with the top surface of the insole positioned at the top.
Figure 6:
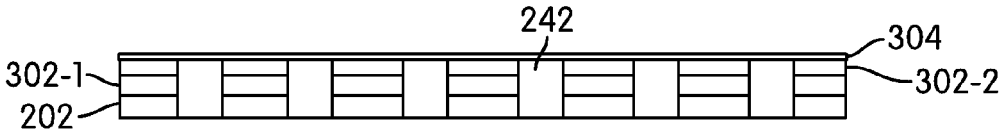
FIG. 6 is a schematic diagram of a cross-sectional view of the exemplary insole of FIG. 2 taken along line 6-6 in FIG. 2, with the top surface of the insole positioned at the top.
Figure 7:
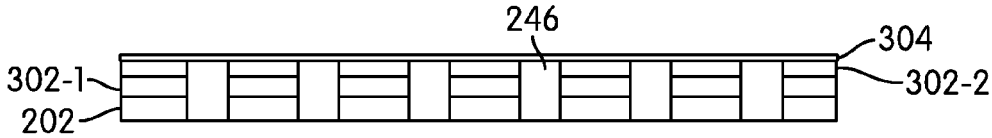
FIG. 7 is a schematic diagram of a cross-sectional view of the exemplary insole of FIG. 2 taken along line 7-7 in FIG. 2, with the top surface of the insole positioned at the top.
Figure 8:
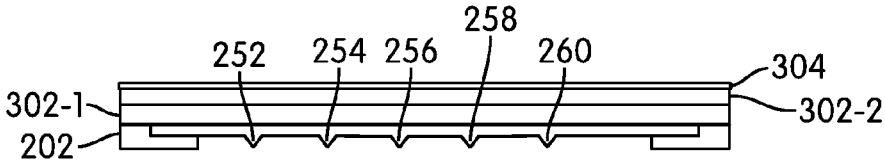
FIG. 8 is a schematic diagram of a cross-sectional view of the exemplary insole of FIG. 2 taken along line 8-8 in FIG. 2, with the top surface of the insole positioned at the top.
Figure 9:
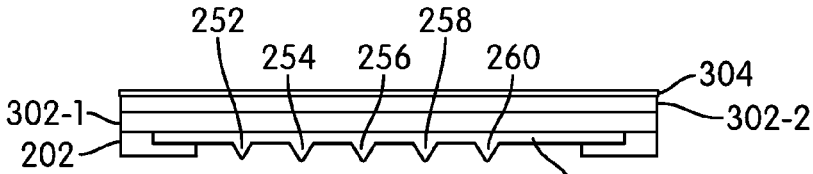
FIG. 9 is a schematic diagram of a cross-sectional view of the exemplary insole of FIG. 2 taken along line 9-9 in FIG. 2, with the top surface of the insole positioned at the top.
Figure 10:
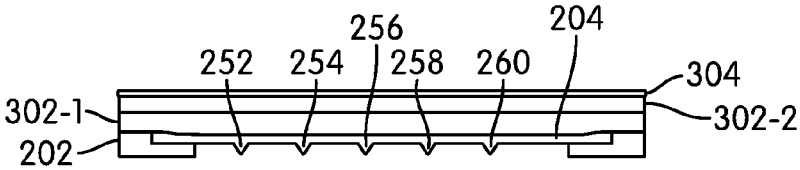
FIG. 10 is a schematic diagram of a cross-sectional view of the exemplary insole of FIG. 2 taken along line 10-10 in FIG. 2, with the top surface of the insole positioned at the top.
Figure 11:
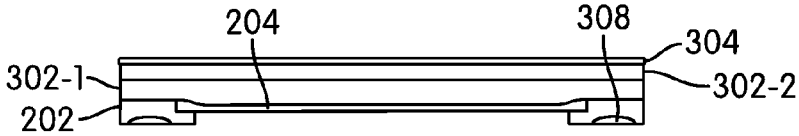
FIG. 11 is a schematic diagram of a cross-sectional view of the exemplary insole of FIG. 2 taken along line 11-11 in FIG. 2, with the top surface of the insole positioned at the top.
Figure 15:
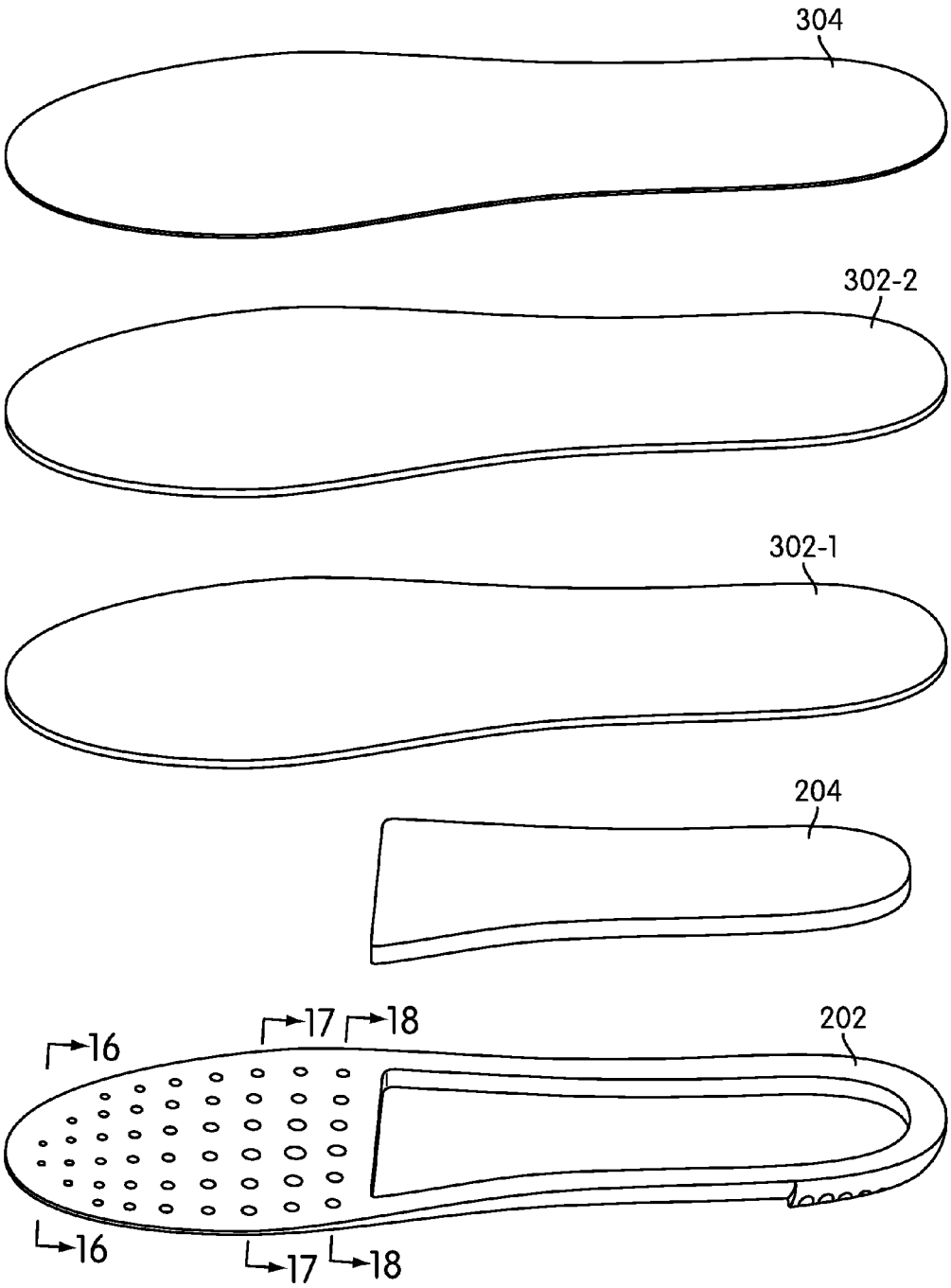
FIG. 15 is a schematic diagram illustrating an exploded isometric view of the insole of FIG. 2 according to an alternative embodiment.
Figure 16:
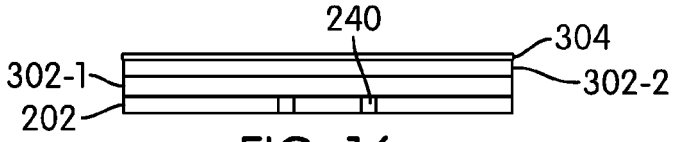
FIG. 16 is a schematic diagram of a cross-sectional view of the alternative exemplary insole of FIG. 15 taken along line 16-16 in FIG. 15, with the top surface of the insole positioned at the top.
Figure 17:
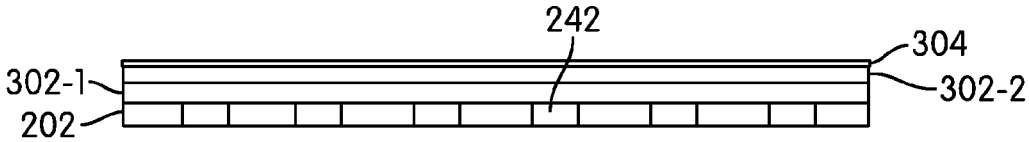
FIG. 17 is a schematic diagram of a cross-sectional view of the alternative exemplary insole of FIG. 15 taken along line 17-17 in FIG. 15, with the top surface of the insole positioned at the top.
Figure 18:
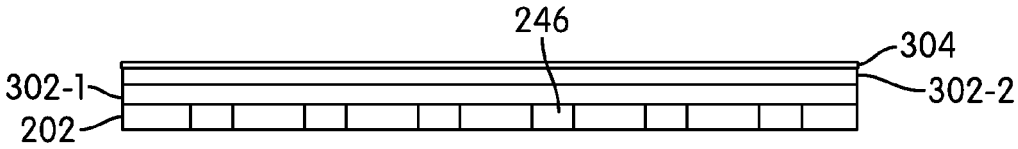
FIG. 18 is a schematic diagram of a cross-sectional view of the alternative exemplary insole of FIG. 15 taken along line 18-18 in FIG. 15, with the top surface of the insole positioned at the top.

In one embodiment, insole 104 may include apertures through one or more layers of insole 104, which may decrease weight, increase air flow, and provide desired flex characteristics. As shown best in FIG. 2, chassis 202 may define a plurality of apertures 230 in the forefoot portion 224. As shown in the cross-sectional views of FIGS. 5-7, lower cushioning layer 302-1 and upper resilient layer 302-2 may also define aligned openings that extend apertures 230, such that apertures 230 are through all three layers of chassis 202, lower cushioning layer 302-1, and upper resilient layer 302-2. In an alternative embodiment, as shown in the exploded view of FIG. 15 and the corresponding cross-sectional views of FIGS. 16-18, only chassis 202 may define apertures 230, with no aligned opening in the remaining layers 302-1, 302-2, and 304.

Apertures 230 may decrease the weight of chassis 202 to provide a lighter and more maneuverable article of footwear, for the benefit of a wearer. Apertures 230 may also increase the air flow through chassis 202, to cool the foot, dry perspiration, and improve the comfort of the insole 104 and article of footwear for a wearer. In addition to these benefits, in one embodiment, the plurality of apertures 230 may be configured to provide tailored flexibility to the chassis 202. In particular, the plurality of apertures 230 may be sized and distributed to promote a gradual increase in flexibility across the chassis 202, and to provide a maximum flexibility where it is most desirable, such as at a joint of the foot.

In one implementation, as shown in FIG. 2, the plurality of apertures 230 are arranged such that, in a direction from the forefoot end 216 toward the heel end 218, the insole apertures increase in size. The increasing size of the apertures increases the flexibility of the chassis 202. In this manner, the forefoot portion 224 of the chassis 202 may be relatively stiff near the forefoot end 216, and become gradually more flexible toward the midfoot portion 204. The gradual increase in flexibility may promote a beneficial rolling characteristic in chassis 202 and insole 104, which may accommodate the natural flexure of a foot to enhance the comfort and performance of an article of footwear in which the insole 104 is used. In one embodiment, the plurality of apertures 230 may progressively increase in size to a point at which maximum flexibility is desired in the forefoot portion 224, which may coincide, for example, with the metatarsophalangeal joints of a foot.

FIG. 2 illustrates one embodiment of a layout of the plurality of apertures 230. As shown, apertures 230 may be arranged in rows that extend generally in a straight line from the lateral side 212 to the medial side 214, and columns that extend generally in a direction from the forefoot end 216 to the heel end 218. In FIG. 2, exemplary rows 236 and 238 and exemplary columns 232 and 234 are indicated by the enclosing dashed lines. Other rows and columns are also shown. As described above, apertures 230 may progressively increase in size in a direction from the forefoot end 216 toward the heel end 218. In the example of FIG. 2, the apertures 230 are circular and increase in diameter. Thus, in column 232, the aperture 240 has the smallest diameter, and moving in a direction toward the heel end 218, the diameters of each successive aperture in column 232 incrementally, or progressively, increase until they reach a maximum diameter, in this case at apertures 242 and 244. A column may include a single aperture that is the maximum diameter, or alternatively, as shown in FIG. 2, may include two or more apertures (apertures 242 and 244) that have the maximum diameter. In the particular implementation of FIG. 2, having two rows 236 and 238 of the maximum diameter may provide a surprising and beneficial maximum flex section that corresponds to, and rolls with, the metatarsophalangeal joints of a foot.

In another embodiment, in moving in a direction from the forefoot to the heel, after reaching a point at which maximum flexibility is desired in the forefoot portion, apertures may then progressively decrease in size to decrease flexibility. For example, as shown in FIG. 2, in a direction from forefoot end 216 toward heel end 218, the row 239 after rows 236 and 238 may have apertures that are smaller than those of rows 236 and 238. For example, aperture 246 may be smaller than apertures 242, 244. Although only one row 239 of decreasing size is shown in FIG. 2, other embodiments may include a plurality of rows of progressively decreasing size moving toward the heel end 218 after reaching the maximum size. This decrease in size, and therefore flexibility, may favorably transition the chassis 202 and insole 104 to a stiffer region toward the midfoot portion 222, which corresponds to a portion of the foot that does not flex as much as the forefoot.

In addition to increasing in size in a longitudinal direction toward the heel end 218, the plurality of apertures 230 may be arranged in rows that have apertures of the same size, as shown in rows 236 and 238, for example. This consistent sizing across a row may provide a consistent flexibility laterally across the chassis 202 and insole 104, so that the chassis 202 and insole 104 bend desirably along lateral lines as the insole 104 flexes through the motion of a stepping foot.

Figure 13:
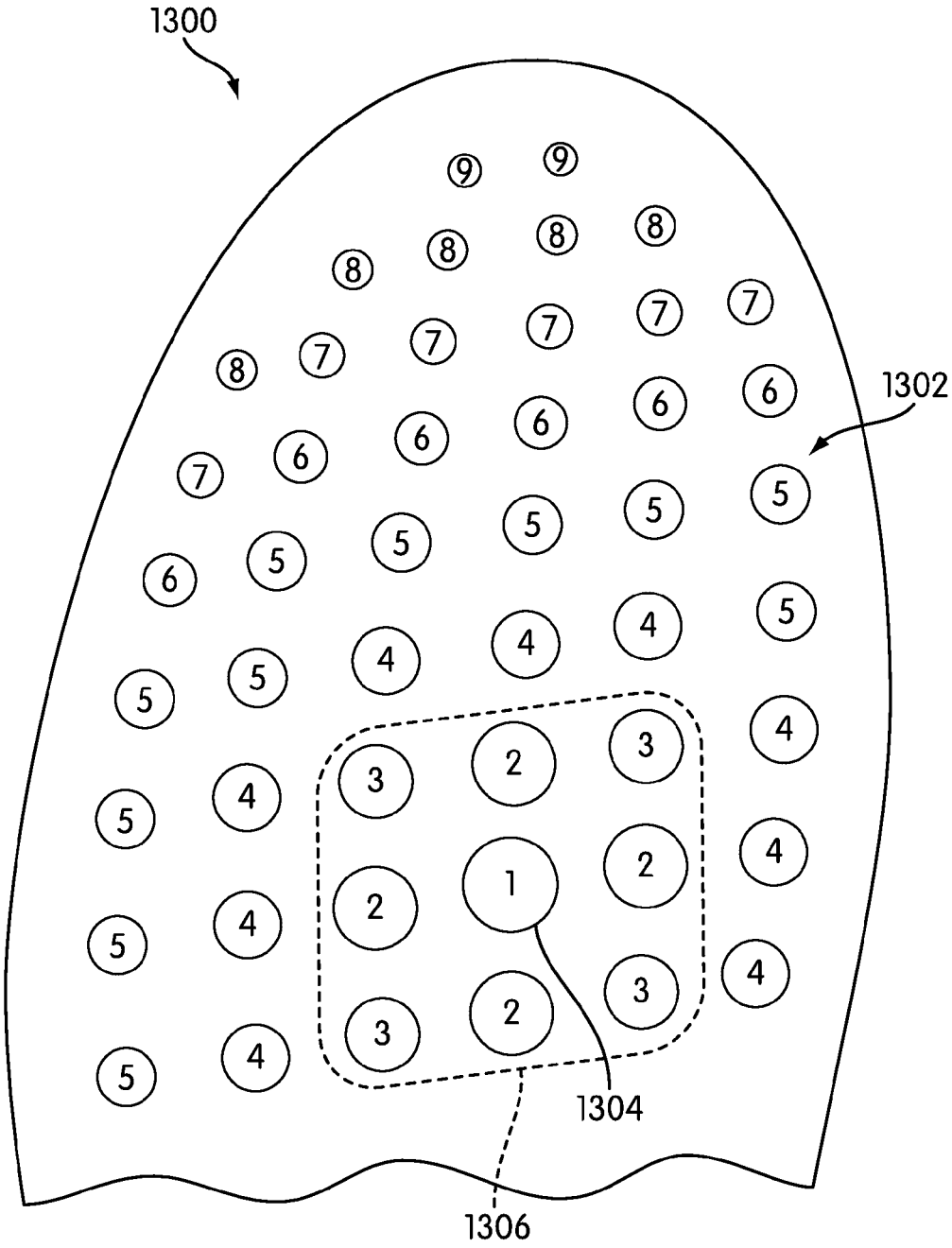
FIG. 13 is a schematic diagram illustrating a bottom view of another embodiment of an insole, which has an exemplary aperture layout and sizing that may provide a cupping flexure for the insole.

Alternatively, apertures of a row may not be the same size and may instead vary in size to accommodate other desired flexing. For example, within a row, apertures closest to the lateral side 212 and medial side 214 may be sized smaller than the apertures toward the middle of the row, which may cause the chassis 202 and insole 104 to cup during flexure, with the regions near the larger middle apertures flexing more than the regions near the outer apertures closest to the sides 212 and 214. The cupping may match anatomical shapes and contours of a bottom of a particular foot, to fit better and provide further comfort. FIG. 13 illustrates an exemplary aperture layout and sizing that may provide a cupping flexure for an insole 1300. As shown, the apertures 1302 may vary in size from sizes 1 to 9, with size 1 being the largest. Aperture 1304 may have the largest size 1 and be positioned at a central area of the forefoot portion, with the surrounding apertures decreasing in size as they become more distant from aperture 1304, as shown. In cupping, the most flexible and deepest region of the insole 104 may generally correspond to the region denoted in FIG. 13 by the dashed line 1306. Alternatively, the largest apertures may be located at other locations of an insole to accommodate other desired flexure or cupping points, for example, to accommodate particular foot shapes and contours.

In addition, instead of cupping an insole, apertures may be sized and positioned to provide a perimeter of the insole that is more flexible than the center of the insole. For example, the largest apertures may be located along the perimeter of the insole, with the smallest apertures in the center, and with a gradual transition in size between those extremes. This particular configuration may accommodate a foot that requires more support in the center and more flexibility at the perimeter.

Referring again to FIG. 2, another embodiment may configure columns of the aperture along curved lines. The curved lines may correspond to the shape and contours of a foot to provide desirable flexing corresponding to the curved flexing of the foot. For example, as shown in FIG. 2, the apertures of column 234 may extend generally along a curved line that curves outward toward the medial side 214, and is concave with respect to the straight column 232. Similarly, to the right of column 234, and closer to the medial side 214, another column of apertures may extend generally along a curved line that also curves outward toward the medial side 214. On the opposite side of the straight column 232, this embodiment may provide three more additional columns, which each may include apertures that extend generally along a curved line that curves outward toward the lateral side 212. In one embodiment, the columns farther from the longitudinal center of the insole 104 may position the apertures along curved lines of a radius of curvature smaller than those of the columns closer to the center. This change in curvature may beneficially provide flexing characteristics that match the shape and flexing of a foot. For example, in the particular implementation of FIG. 2, the five toes of a wearer's foot may fit roughly within the five open spaces between the six columns of apertures 230.

Although embodiments described above disclose particular patterns of apertures, other embodiments may use other patterns and random distributions of apertures that include apertures sized relative to each other to provide desired flexibility. For example, instead of arranging apertures in rows and columns in a forefoot portion, apertures could be randomly placed within a forefoot portion, but progressively sized so that the size of any one aperture depends upon its distance from the forefoot end. In other words, the randomly placed apertures may progressively increase in size in a direction generally from the forefoot end toward the heel end. Thus, notwithstanding the particular benefits associated with arranging the apertures in rows and columns, embodiments should be considered broadly applicable to any apertures progressively sized to create desired flex characteristics.

Figure 14:
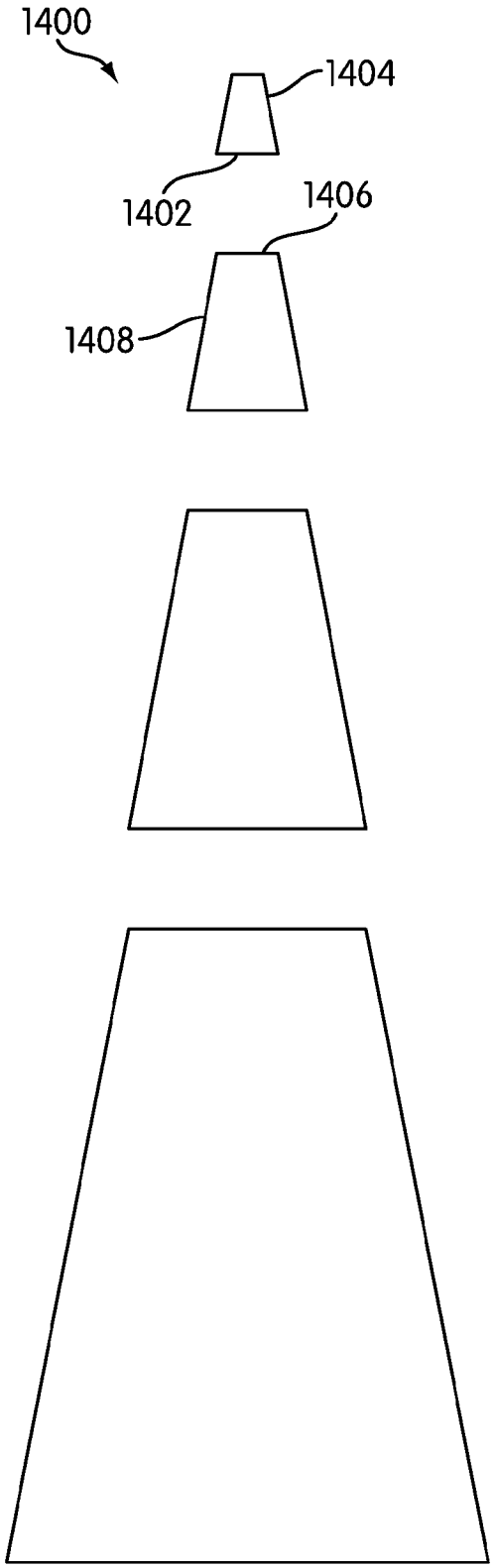
FIG. 14 is a schematic diagram illustrating another embodiment of insole apertures, shaped as isosceles trapezoidal apertures.

In addition, although embodiments described above use circular apertures, other embodiments may use differently shaped apertures, such as oval or polygonal shapes (e.g., triangular, square, rectangular, pentagonal, hexagonal, or octagonal shapes). For example, an insole may include apertures shaped as isosceles trapezoids, with two non-parallel sides of equal length and with both angles coming from a parallel side being equal. As shown in FIG. 14, in a column of such isosceles trapezoidal apertures 1400 running from a forefoot end toward a heel end, the apertures may be oriented with the non-parallel sides running with the column and may be sized such that, moving in a direction toward the heel end, the large parallel side 1402 of a first aperture 1404 is less than or equal in width to the small parallel side 1406 of a second subsequent aperture 1408. In this manner, the isosceles trapezoidal apertures may increase in width gradually in a direction from the forefoot end toward the heel end, which may provide a desired gradual increase in flexibility across the forefoot portion. Accordingly, notwithstanding the particular benefits associated with circular apertures, embodiments should be considered broadly applicable to any apertures shaped and sized relative to each other to create desired flex characteristics.

An embodiment of the chassis 202 and insole 104 may also provide structural support along the perimeter of the heel portion 220. For example, chassis 202 may include a heel portion perimeter member 306 that may be thicker than other perimeter portions of the chassis 202, such as along the lateral side 212 and medial side 214 of the midfoot portion. Heel portion perimeter member 306 may provide a tight, rigid fit against the inner edges of an article of footwear, to keep the insole 104 in place and to prevent the insole 104 from buckling at the edges. Heel portion perimeter member 306 may also promote a cupping shape to the heel portion 220 of insole 104 to provide comfort and support to a wearer's heel. To reduce weight, heel portion perimeter member 306 may include isolated areas from which material is removed, such as recesses or holes. For example, as shown in the embodiment of FIG. 2, heel portion perimeter member 306 may include a line of recesses 308 along the perimeter of the heel portion 220. Recesses 308 may enable a lightweight design while still providing adequate structural support.

To provide further structural support and desired flex characteristics, an embodiment provides longitudinal structural members in the support member 204. For example, as shown in FIG. 2, support member 204 may include a plurality of ribs 250. Ribs 250 may be sized, shaped, and positioned to provide desired support and flex characteristics. In one embodiment, the plurality of ribs 250 may include five ribs 252, 254, 256, 258, 260. Ribs 250 may protrude from the bottom of support member 204. In one embodiment, ribs 250 may be shaped generally as semi-circles when viewed in cross-section. In another embodiment, ribs 250 may be somewhat pointed as shown in the cross-sectional views of FIGS. 8-10.

Ribs 250 may all protrude a uniform distance (i.e., thickness) from support member 204, or may protrude at varying distances to provide more or less rigidity as desired. For example, in one embodiment, a middle rib 256 may protrude more than ribs 254, 258, and ribs 254, 258 may protrude more than ribs 252, 260, which may provide a more rigid longitudinal center of support member 204 that gradually transitions to more flexible outer portions of the support member 204 along the lateral side 212 and medial side 214. In another embodiment, a rib may protrude a greatest distance at one side (lateral or medial) of the support member 204, with the remaining ribs protruding at incrementally smaller distances. In this manner, support member 204 may provide more rigidity on one side (lateral or medial) as desired for a specific application. For example, rib 260 may protrude a greatest distance, with ribs 258, 256, 254, 252 protruding progressively smaller distances, thereby providing a more rigid medial side 214 of support member 204, which may be useful for wearers needing additional arch support.

The size and shape of plurality of ribs 250 may also vary longitudinally to transition support member 204 between different longitudinal portions of rigidity. For example, as shown in FIGS. 2 and 8-10, ribs 250 may be wider and thicker in a central longitudinal section and less wide and thick toward the ends. Ribs 250 may gradually transition in width and thickness as shown best in FIG. 2. This gradual transition may provide a wearer with a desirable smooth and comfortable change in rigidity in a longitudinal direction along the insole 104, which may be most perceptible during a stepping motion.

In addition to varying widths and thicknesses, the plurality of ribs 250 may also be positioned relative to each other to provide desired flex characteristics. For example, ribs 250 may curve relative to each other to provide desired directions of flexure. In one embodiment, as shown in FIG. 2, a plurality of ribs 250 may include a straight middle rib 256, with the remaining ribs 252, 254, 258, 260 curved with respect to the straight middle rib 256, in this case convex with respect to rib 256. The curved configuration may promote favorable flex and bending characteristics in insole 104, with the insole 104 flexing with the curved portions of a wearer's foot, such as the arch of the foot. The degree of curving may also be tailored to a desired flex. For example, as shown in FIG. 2, rib 260 may have a smaller radius of curvature than rib 258, and rib 252 may have a smaller radius of curvature than rib 254. These changes in curvature may provide more curving at the lateral and medial sides of the insole to accommodate the curved flexing of a foot and to promote the roll of the foot from the heel, across the arch, and to the forefoot.

The plurality of ribs 250 may also include longitudinal ends that provide desired transitions to less rigid portions of support member 204. For example, as shown in FIG. 2, ribs 250 may have first ends in the midfoot portion that are generally aligned along a line extending laterally from the medial side 214 to the lateral side 212, and second ends that are positioned at different distances from the heel end 218. As shown, the second end of rib 256 may be closest to heel end 218, the second ends of ribs 254 and 258 may be next closest to heel end 218, and the second ends of ribs 252 and 260 may be farthest from the heel end 218. This configuration of the second ends may provide a desirable transition of rigidity into the heel portion 220 of insole 104, for example, providing more rigidity for the center portion of a wearer's midfoot and heel. If less rigidity is desired for the wearer's heel, the second ends of the ribs 250 may be the inverse of the configuration shown in FIG. 2, with the second end of middle rib 256 farthest from heel end 218, with the second ends of ribs 252 and 260 closest to the heel end 218, and with the second ends of ribs 254 and 258 in between. In that alternative inverse configuration, the second ends of the ribs 250 may also be positioned on a curved line or arc that corresponds generally to the round interior contour of a wearer's heel.

Figure 12:
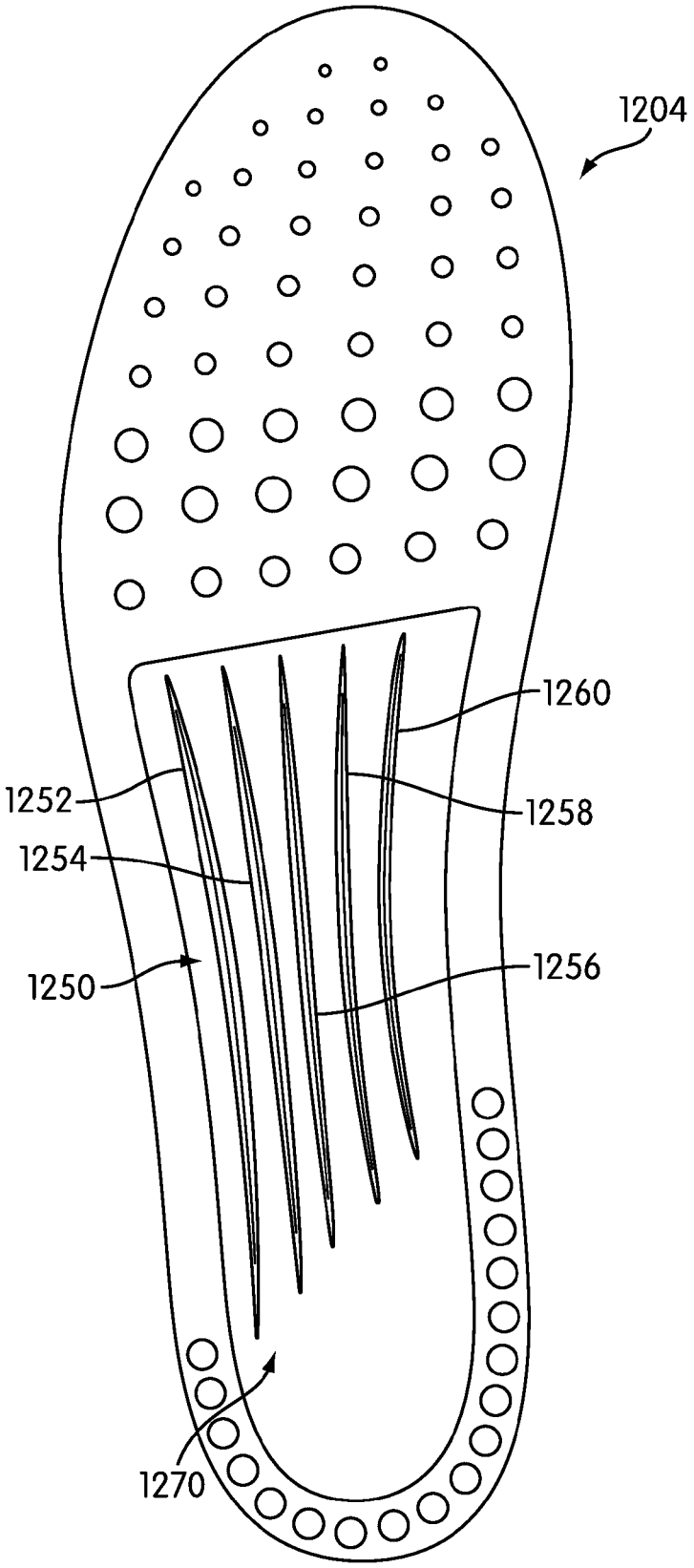
FIG. 12 is a schematic diagram illustrating a plan view of the bottom of another embodiment of an insole.

In another embodiment, the second ends of ribs 250 may be staggered to promote greater flexing on one side (lateral or medial) of an insole 104. For example, as shown in FIG. 12, an insole 1204 may have a plurality of ribs 1250 whose second ends 1270 nearest the heel end are staggered, with the rib 1252 (closest to the lateral side of the insole) extending closest to the heel end, with the rib 1260 (closest to the medial side of the insole) farthest from the heel end, and with the seconds ends of ribs 1258, 1256, 1254 being progressively closer to the heel end moving from a direction from the medial side to the lateral side. This staggered configuration may provide more flexibility on the medial side and less flexibility on the lateral side, which may promote greater comfort and support for a wearer's foot.

Referring again to FIGS. 3-11, in some embodiments, insole 104 may include an insole liner 304 that helps to provide extra cushioning for a wearer's foot. In some embodiments, insole liner 304 may include additional properties that may be desirable for a footwear insert. Insole liner 304 may comprise a cloth material in some embodiments. Insole liner 304 may include an upper side and a lower side. Lower side of insole liner 304 is disposed along an upper surface of cushioning layer 302. Upper side of insole liner 304 is disposed closest to a wearer's foot. Insole liner 304 may or may not define apertures aligned with apertures of the other layers of insole 104.

Another embodiment provides a method for manufacturing an insole, such as the multi-layered insole 104 shown in FIGS. 2-4. The individual layers of the insole 104 may be separately formed and assembled together as shown in the exploded view of FIG. 4. The layers may be attached to each other, for example, by stitching or by an adhesive. Certain layers, such as support member 204, may be held in place by being sandwiched between adjacent layers. The individual layers may have apertures that are aligned when the layers are attached to each other, for example, as shown in the chassis 202, the lower cushioning layer 302-1, and the upper resilient layer 302-2.

Optionally, instead of cutting the layers into the desired insole shape and attaching them to each other, another embodiment attaches sheets of material together into a laminate sheet and then cuts the desired insole shape from the laminate sheet. Aligned apertures may be formed in the sheets before attaching them, or may be cut after the sheets are attached. Referring to FIG. 4, lower cushioning layer 302-1, upper resilient layer 302-2, and insole liner 304 may be formed in this manner before attaching support member 204 and chassis 202.

In another embodiment, layers of an insole may be injection molded together, for example, by insert molding or over molding.

Another embodiment provides a method for customizing the size, shape, and layout of support structures of an insole. For example, the size, shape, and layout of apertures and ribs of an insole may be customized to accommodate a specific anatomical structure of a wearer's foot. In a first step, a wearer's foot may be analyzed to determine the locations and sizes of parts of the wearer's foot, such as bones, joints, and ligaments. In a next step, the layout of apertures and ribs may be designed to fit the specific anatomy. For example, columns of apertures may be precisely aligned and positioned to place bones and toes of the foot within open spaces between the columns. In addition, rows of maximum-sized apertures may be precisely aligned to place rows of apertures along joints of the foot, such as the metatarsophalangeal joints of a foot. In a further embodiment, ribs of a support member may be shaped and placed to correspond to the shape and location of bones in a wearer's foot, for example, following the pronation of an arch.

Overall, embodiments provide an orthotically favorable insole that may provide structure and protection to a player, and may match inside dimensions of an article of footwear to provide a tight and stable fit inside the article of footwear. The multi-layered construction may distribute stud pressure and cushion a wearer's foot for desirable comfort. The layers may be made of soft material for flexibility and to protect the inside of the article of footwear. Apertures in the forefoot portion may increase flexibility in that area. The support member, which may be made of a hard material from approximately the midfoot to the heel, may provide midfoot protection, and maintain heel cupping and arch support. The hard material of the support member may also define ribs to provide midfoot stiffness. To reduce weight, the heel of the insole may include recesses or holes, for example, along the perimeter of the heel.

Embodiments therefore provide an insole with structural features, such as apertures and ribs, that are strategically sized, shaped, and located to yield surprising and beneficial results related to the support, comfort, and flex characteristics of an insole. In particular, embodiments provide a four layered construction from the midfoot portion of an insole to the heel portion of the insole, particular layouts, lengths, and curvatures of ribs in the midfoot portion, and particular layouts, lengths, and patterns of apertures in the forefoot portion.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present invention.

What is claimed is:

1. An insole for an article of footwear, the insole comprising:

a chassis having an upper surface and a lower surface, a lateral side and a medial side, a heel end and a forefoot end, and a heel portion, a midfoot portion, and a forefoot portion, wherein the chassis defines a support member opening extending from the heel portion to the midfoot portion, and wherein the chassis defines a plurality of first apertures in the forefoot portion;

a cushioning layer attached to the upper surface of the chassis and extending from the heel end to the forefoot end, wherein the cushioning layer defines a plurality of second apertures each aligned with a first aperture of the plurality of first apertures to provide a plurality of insole apertures;

a support member extending from the heel portion of the chassis to the midfoot portion of the chassis and covering the support member opening of the chassis, wherein, in a direction from the forefoot end toward the heel end, the insole apertures progressively increase in size to a point at which maximum flexibility is desired in the forefoot portion, wherein, in a direction from the medial side to the lateral side, the insole apertures progressively increase in size to the point at which maximum flexibility is desired in the forefoot portion, wherein, in a direction from the lateral side to the medial side, the insole apertures progressively increase in size to the point at which maximum flexibility is desired in the forefoot portion, and wherein the support member has a first end at the midfoot portion and a second end at the heel portion, wherein the support member defines an arch protrusion at the first end on the medial side, and wherein the support member defines a cupped shape at the second end.

2. The insole of claim 1, wherein the point at which maximum flexibility is desired in the forefoot portion is along a line from the medial side to the lateral side, wherein the line is positioned generally to correspond to the metatarsophalangeal joints of a foot.

3. The insole of claim 2, wherein, from the point toward the heel portion, the insole apertures decrease in size.

4. The insole of claim 1, wherein the plurality of insole apertures comprises rows of apertures aligned in straight lines extending generally from the lateral side to the medial side, and columns of apertures running in a direction generally from the forefoot end to the heel end.

5. The insole of claim 4, wherein the columns of apertures comprise a first column having apertures aligned in a straight line, a medial side column having apertures positioned along a curved line that curves outward toward the medial side, and a lateral side column having apertures positioned along a curved line that curves outward toward the lateral side.

6. The insole of claim 1, wherein the insole apertures comprise a largest insole aperture at a central area of the forefoot portion and a plurality of surrounding insole apertures that are smaller than the largest insole aperture and decrease in size as the surrounding apertures are more distant from the largest insole aperture, to provide cupping flexure for the insole.

7. The insole of claim 1, wherein the chassis defines recesses along its perimeter in the heel portion.

8. The insole of claim 1, wherein the cushioning layer is multilayered and comprises a lower cushioning layer attached to the chassis and an upper resilient layer attached to the lower cushioning layer.

9. The insole of claim 1, further comprising an insole liner attached to the cushioning layer on a side of the cushioning layer opposite to the chassis.

10. The insole of claim 1, wherein the support member comprises a first material, the chassis comprises a second material, and the cushioning layer comprises a third material, and wherein the first material is more rigid than the second material, and wherein the second material is more rigid than the third material.

11. The insole of claim 1, wherein the chassis includes a heel portion perimeter member that is thicker than other perimeter portions of the chassis to promote a cupping shape to a heel portion of the insole.

12. The insole of claim 11, wherein the heel portion perimeter member defines recesses to reduce weight while still providing structural support.

13. The insole of claim 1, further comprising the article of footwear.

14. The insole of claim 1, wherein the support member is sized and shaped larger than the support member opening of the chassis such that perimeter portions of the support member are disposed between the cushioning layer and the chassis.

15. An insole for an article of footwear, the insole comprising:

a chassis having an upper surface and a lower surface, a lateral side and a medial side, a heel end and a forefoot end, and a heel portion, a midfoot portion, and a forefoot portion, wherein the chassis defines a support member opening extending from the heel portion to the midfoot portion, and wherein the chassis defines a plurality of first apertures in the forefoot portion;

a cushioning layer attached to the upper surface of the chassis and extending from the heel end to the forefoot end, wherein the cushioning layer defines a plurality of second apertures each aligned with a first aperture of the plurality of first apertures to provide a plurality of insole apertures;

a support member extending from the heel portion of the chassis to the midfoot portion of the chassis and covering the support member opening of the chassis, wherein, in a direction from the forefoot end toward the heel end, the insole apertures progressively increase in size to a point at which maximum flexibility is desired in the forefoot portion, wherein, in a direction from the medial side to the lateral side, the insole apertures progressively increase in size to the point at which maximum flexibility is desired in the forefoot portion, wherein, in a direction from the lateral side to the medial side, the insole apertures progressively increase in size to the point at which maximum flexibility is desired in the forefoot portion, and wherein the support member has a plurality of ribs each protruding from a surface of the support member opposite to the cushioning layer and extending generally in a longitudinal direction from the midfoot portion toward the heel portion, wherein the plurality of ribs comprises a first rib aligned in a straight line parallel to the longitudinal direction, a medial side rib that is convex with respect to the first rib, and a lateral side rib that is convex with respect to the first rib.

16. The insole of claim 15, wherein each rib of the plurality of ribs comprises a first end and a second end, and wherein the each rib increases in width and thickness from the first and second end to a widest and thickest middle portion.

17. The insole of claim 15, wherein the first rib, the medial side rib, and the lateral side rib each have a first end disposed in the midfoot portion and a second end opposite to the first end, wherein the first ends are generally aligned in a direction from the medial side to the lateral side, and wherein the second end of the first rib extends farther toward the heel end than the second end of the medial side rib, and wherein the second end of the lateral side rib extends farther toward the heel end than the second end of the first rib.

18. The insole of claim 15, wherein the medial side rib comprises a first medial side rib and wherein the lateral side rib comprises a first lateral side rib, wherein the plurality of ribs further comprises a second medial side rib and a second lateral side rib, wherein the second medial side rib is disposed on a side of the first medial side rib opposite to the first rib, wherein the second lateral side rib is disposed on a side of the first lateral side rib opposite to the first rib, wherein the second medial side rib is convex with respect to the first rib, and wherein the second lateral side rib is convex with respect to the first rib.

19. The insole of claim 18, wherein the second medial side rib has a radius of curvature less than that of the first medial side rib, and wherein the second lateral side rib has a radius of curvature less than that of the first lateral side rib.

20. The insole of claim 18, wherein the first rib, the first medial side rib, the second medial side rib, the first lateral side rib, and the second lateral side rib each have a first end disposed in the midfoot portion and a second end opposite to the first end, wherein the first ends are generally aligned in a direction from the medial side to the lateral side, wherein the second end of the first medial side rib extends farther toward the heel end than the second end of the second medial side rib, wherein the second end of the first rib extends farther toward the heel end than the second end of the first medial side rib, wherein the second end of the first lateral side rib extends farther toward the heel end than the second end of the first rib, and wherein the second end of the second lateral side rib extends farther toward the heel end than the second end of the first lateral side rib.

21. The insole of claim 18, wherein the first rib, the first medial side rib, the second medial side rib, the first lateral side rib, and the second lateral side rib each have a first end disposed in the midfoot portion and a second end opposite to the first end, wherein the first ends are generally aligned in a direction from the medial side to the lateral side, wherein the second end of the first medial side rib extends farther toward the heel end than the second end of the second medial side rib, wherein the second end of the first rib extends farther toward the heel end than the second end of the first medial side rib and the second end of the first lateral side rib, wherein the second end of the first lateral side rib extends farther toward the heel end than the second end of the second lateral side rib, wherein the second ends of the first medial side rib and the first lateral side rib are generally aligned in the direction from the medial side to the lateral side, and wherein the second ends of the second medial side rib and the second lateral side rib are generally aligned in the direction from the medial side to the lateral side.

22. An insole for an article of footwear, the insole comprising:

a chassis layer having an upper surface and a lower surface, a lateral side and a medial side, a heel end and a forefoot end, and a heel portion, a midfoot portion, and a forefoot portion, wherein the chassis layer defines a plurality of apertures in the forefoot portion, wherein, in a direction from the forefoot end to the heel end, the apertures progressively increase in size to a point at which maximum flexibility is desired in the forefoot portion, wherein, in the direction from the forefoot end to the heel end, each aperture progressively increases in width, and wherein each aperture has an isosceles trapezoidal shape and is oriented with non-parallel sides running in the direction from the forefoot end to the heel end, and wherein the plurality of apertures are sized such that, moving in a direction from the forefoot end to the heel end, a large parallel side of a first aperture is less than or equal in width to a small parallel side of a second subsequent aperture.

23. The insole of claim 22, wherein the point at which maximum flexibility is desired in the forefoot portion corresponds to a line from the medial side to the lateral side, wherein the line is positioned generally to correspond to the metatarsophalangeal joints of a foot.

24. The insole of claim 22, wherein the plurality of apertures are arranged in a plurality of rows, wherein each row extends in a direction generally from the medial side to the lateral side, and wherein, in each row, the apertures have the same size.

25. The insole of claim 22, wherein the plurality of apertures are arranged in a plurality of rows and each row extends in a direction generally from the medial side to the lateral side, wherein the plurality of apertures are arranged in columns of apertures running in a direction generally from the forefoot end to the heel end, wherein the columns of apertures comprise a first column having apertures aligned in a straight line, a medial side column having apertures positioned along a curved line that curves outward toward the medial side, and a lateral side column having apertures positioned along a curved line that curves outward toward the lateral side.

26. The insole of claim 22, wherein, in the direction from the forefoot end to the heel end, after the point at which maximum flexibility is desired, each aperture progressively decreases in width.

* * * * *